US005904075A

United States Patent [19]

Buck

[11] Patent Number: 5,904,075

[45] Date of Patent: May 18, 1999

[54] INTERLOCKING JAW POWER TONGS

[76] Inventor: David A. Buck, 1348 Sawmill Highway, Breaux Bridge, La. 70517

[21] Appl. No.: 08/806,074

[22] Filed: Feb. 25, 1997

Related U.S. Application Data

[63] Continuation-in-part of application No. 08/728,761, Oct. 11, 1996, Pat. No. 5,819,604.

[51] Int. Cl.[6] ..... B25B 13/50

[52] U.S. Cl. ..... 81/57.18; 81/57.2; 81/57.21

[58] Field of Search ..... 81/57.15, 57.16, 81/57.18, 57.2, 57.21, 57.33, 57.34

[56] References Cited

U.S. PATENT DOCUMENTS

| | | | |
|---|---|---|---|
| 2,544,639 | 3/1951 | Calhoun | 255/35 |
| 3,180,186 | 4/1965 | Catland | 81/57 |
| 3,545,313 | 12/1970 | Kelley | 81/57.34 |
| 3,799,009 | 3/1974 | Guier | 81/57.16 |
| 4,030,746 | 6/1977 | Langowski | 294/88 |
| 4,084,453 | 4/1978 | Eckel | 81/57.18 |
| 4,304,433 | 12/1981 | Langowski | 294/106 |
| 4,381,169 | 4/1983 | Muhr et al. | 414/753 |
| 4,404,876 | 9/1983 | Eckel | 81/57.18 |
| 4,426,869 | 1/1984 | Farmer et al. | 72/104 |
| 4,441,749 | 4/1984 | Blaschke et al. | 294/88 |
| 4,546,681 | 10/1985 | Owsen | 82/38 |
| 4,576,067 | 3/1986 | Buck | 81/185.1 |
| 4,631,987 | 12/1986 | Buck | 81/57.14 |
| 4,647,099 | 3/1987 | Berry et al. | 81/57.14 |
| 4,649,777 | 3/1987 | Buck | 81/57.19 |
| 4,709,599 | 12/1987 | Buck | 81/57.18 |
| 4,759,239 | 7/1988 | Hamilton et al. | 81/57.34 |
| 4,811,635 | 3/1989 | Falgout, Sr. | 81/57.33 |
| 5,150,642 | 9/1992 | Moody et al. | 81/57.2 |
| 5,291,808 | 3/1994 | Buck | 81/57.18 |
| 5,417,464 | 5/1995 | Seaberg et al. | 294/88 |
| 5,542,318 | 8/1996 | Wesch, Jr. | 81/57.33 |

*Primary Examiner*—D. S. Meislin
*Attorney, Agent, or Firm*—Roy, Kiesel & Tucker

[57] ABSTRACT

The present invention provides an improved power tong a body having with a rotating assembly. The power tong further has a plurality of jaw members positioned within the rotating assembly with two of the jaw members being pivoting jaws adapted to interlock when in a closed position. In an alternate embodiment, the improved power tong will have a compensating jaw assemble to limit the axial load placed on the tubular member being gripped.

13 Claims, 7 Drawing Sheets

INTERLOCKING JAW POWER TONGS

This is a continuation-in-part of application Ser. No. 08/728,761 filed on Oct. 11, 1996, now U.S. Pat. No. 5,819,604, which is hereby incorporated by reference into this application.

BACKGROUND OF INVENTION

The present invention relates to power tongs typically used in the oil and gas industry to make up and break apart threaded joints on pipe, casing and similar tubular members.

Power tongs have been in existence for many years and are generally employed in the oil and gas industry to grip and rotate tubular members, such as drill pipe. It is necessary to grip drill pipe with high compressive forces while applying a high degree of torque in order to break apart or tighten threaded pipe connections. In most cases, power tong designs employ a cam mechanism for converting a portion of the torque into a gripping (compressive) force normal to the pipe. This conversion is often accomplished utilizing a power-driven ring gear having an interior cam surface. A cam follower (roller) on a jaw member rides upon the cam surface. As the ring gear is rotated, the follower (and thus the jaw member) is urged into contact with the pipe. An example of such an arrangement can be seen in U.S. Pat. No. 4,404,876.

Most current power tong designs include a ring gear camming member with an open slot or throat, through which the drill pipe is passed in order to place the power tong in position around the pipe. Some tong designs employ a ring gear camming member which has no open throat and is thus a solid circular member. However, a power tong with a solid ring gear camming member must be employed by passing it over the end of a pipe because there is no open throat to facilitate installation. A power tong with a solid ring gear must be left in place around the pipe until conditions permit removal by sliding the tong off one end of the pipe.

Due to the tremendous forces generated during use, open throat power tongs must resist spreading during use. Prior art open throat tongs employ heavy duty rollers and other support structure to resist spreading. Despite such precautions, prior art tongs often spread and fail during use, resulting in tremendous costs and down time during expensive drilling operations. While power tongs having solid circular camming members do not have the spreading problem, the versatility of open throat designs is much preferred.

Another problem often encountered with power tongs using a rotating cam surface to grip the tubular member is that the axial load on the tubular member is proportional to the torque. Therefore in applications where high torque forces are needed, these types of power tongs may transmit such a high axial load to the tubular member that the tubular member is damaged or rendered unusable.

OBJECTS AND SUMMARY OF THE INVENTION

It is therefore an object of this invention to provide a power tongs tool which does not subject the ring gear to spreading forces.

It is another object of this invention to provide a manner of limiting the axial load on a tubular member when high torque forces are required.

Therefore the present invention provides an improved power tong a body having with a rotating assembly. The power tong further has a plurality of jaw members positioned within the rotating assembly with two of the jaw members being pivoting jaws adapted to interlock when in a closed position. In an alternate embodiment, the improved power tong will have a compensating jaw assemble to limit the axial load placed on the tubular member being gripped.

DETAILED DESCRIPTION

Figure 1:
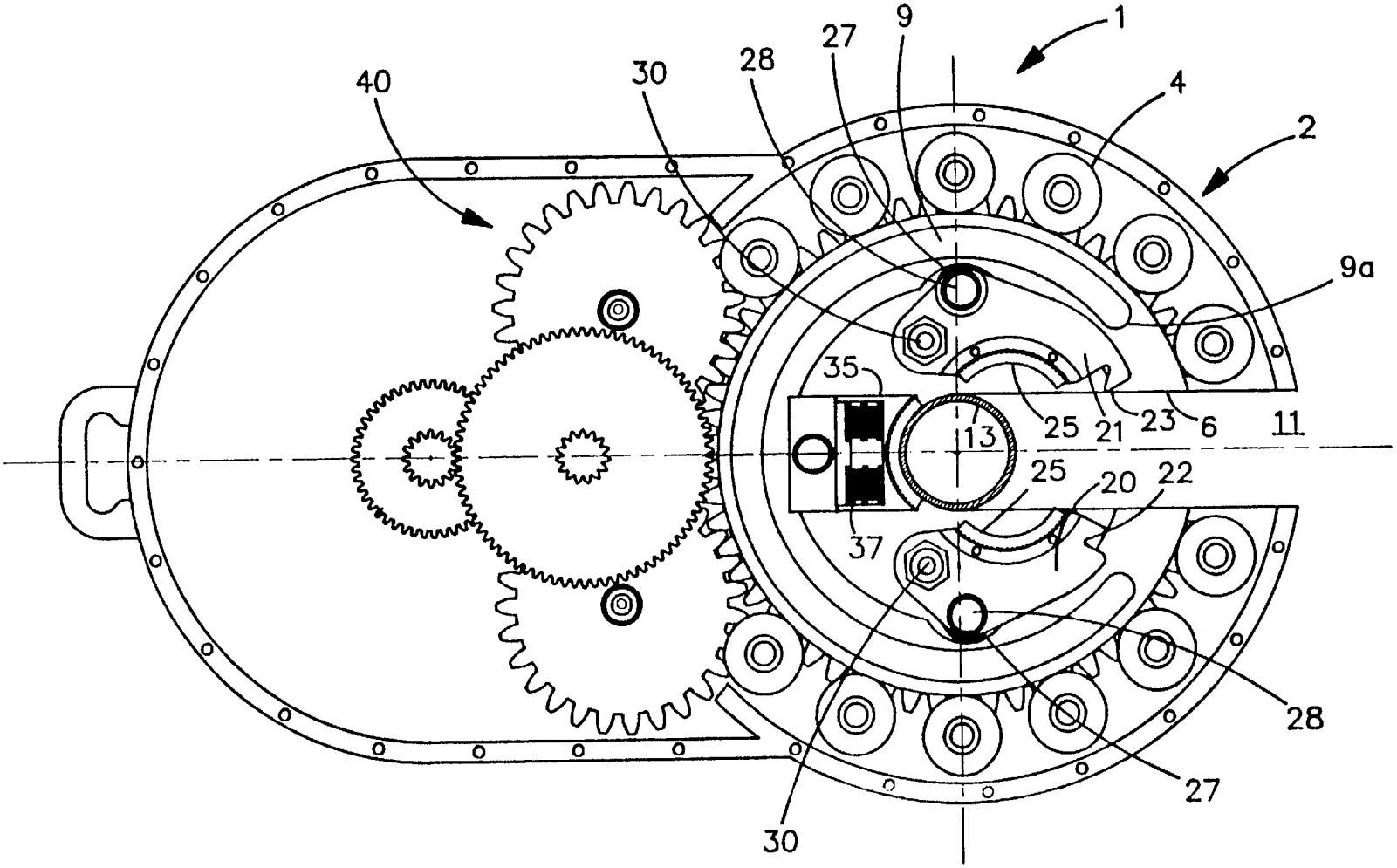
FIG. 1 is a top view of the present invention with the top cage plate removed showing the jaw members in an open position.

FIG. 1 illustrates one preferred embodiment of the present invention. Power tong 1 is of the type having an open throat 11. FIG. 1 shows power tong 1 with the cover plate and cage plate removed in order to show the main internal components positioned within frame 2 of power tong 1. Frame 2 contains a series of rollers 4 running along the inner periphery of front end 3 of frame 2. Ring gear 6 is positioned between and supported by rollers 4 such that ring gear 6 may rotate within frame 2. The outer periphery of ring gear 6 will have a series of gear teeth 7 positioned thereon. Gear teeth 7 will engage the cogs of drive train 40 in order to impart torque to ring gear 6. Drive train 40 is a conventional drive mechanism well known in the art. The inner periphery of ring gear 6 will also have a plurality of cam surfaces formed thereon which will operate to open and close jaws 20, 21 and 35, the function of which will be explained in greater detail below. As best seen in the perspective view of FIG. 3, ring gear 6 will further have channel 9 formed on its upper and lower surfaces. Channel 9 is sized to engage roller bearings 45 which can be seen on lower cage plate 16. While hidden from view in FIG. 3, identical roller bearings 45 are positioned on upper cage plate 15. It will be understood that when ring gear 6 is assembled in power tong 1 between upper and lower cage plates 15 and 16, ring gear 6 is able to rotate relative to cage plates 15 and 16 on roller bearing 45. However, while ring gear 6 is able to rotate between cage plates 15 and 16, the degree of rotation is limited. As ring gear 6 continues to rotate relative to cages plates 15 and 16, the end 9*a* of channel 9 will engage stop pins 43 on both the upper and lower cages plates 15 and 16, whereupon relative movement between ring gear 6 and cage plates 15 and 16 will cease. While the stop pins 43 on cage plate 15 are hidden from view, they will occupy the same position as stop pins 43 on cage plate 16. The role play by relative movement between ring gear 6 and cage plates 15 and 16 play in the power tongs function will be explained in greater detail below. In the embodiment shown in FIG. 3, top and bottom cage plates 15 and 16 along with ring gear 6 will generally comprise a rotative assembly in which will rotate jaws 20, 21, and 35 in order to apply torque to tubular member 13 (tubular member 13 is not shown in FIG. 3). However, the rotative assembly could be comprised of any group of parts that supply rotary motion necessary to generate torque.

Returning now to FIG. 1, positioned within ring gear 6 are two pivoting jaws 20 and 21 and an axial jaw 35. Pivoting jaws 20 and 21 are substantially identical except for their respective locking hooks 22 and 23. Locking hooks 22 and 23 are merely one preferred embodiment for allowing pivoting jaws 20 and 21 to interlock and all methods of interlocking the pivoting jaws are considered within the scope of this invention. Similarly, while not shown in the figures, the scope of the present invention is also intended to include pivoting jaws without locking hooks. Pivoting jaws 20 and 21 will be pivotally attached to, and disposed between, top cage plate 15 and bottom cage plate 16 by pivot pin 30. It will be understood that top cage plate 15 and bottom cage plate 16 are fixedly attached to one another by any conventional means such that they may rotate together while allowing relative rotation of ring gear 6 within cage plates 15 and 16. Pivoting jaws 20 and 21 further include can followers 27 which will be pinned in place by follower pins 28 such that cam followers 27 may freely rotate on follower pins 28. It will be understood that the pivoting jaws 20 and 21 are assembled inside of ring gear 6 and between cage plates 15 and 16 and pivoting jaws 20 and 21 will be free to pivot on pins 30 toward and away form the center point of power tongs 1. The side of pivoting jaws 20 and 21 which face tubular member 13 will have die inserts 25 positioned or incorporated thereon, which will provide the actual gripping surface for securely holding tubular member 13 against the high torque loads that will be encountered. An example one suitable die insert 25 can be seen in U.S. Pat. No. 4,576,067 to David Buck, which is incorporated by reference herein. Another suitable die 25 can be seen in a pending application to Daniel Bangert filed on Sep. 13, 1996, application Ser. No. 08/713,444, also incorporated herein by reference. The embodiment shown also includes a third jaw, axial jaw 35. Axial jaw 35 has a cam follower 27 and follower pin 28 as do pivoting jaws 20 and 21, and axial jaw 35 is likewise disposed between upper and lower cage plates 15 and 16, but axial jaw 35 is not pivotally pinned to cage plates 15 and 16. While not shown in the Figures, upper and lower cages plates 15 and 16 will have a short longitudinal channel formed therein and oriented in a direction toward the center point of tubular member 13. Follower pin 28 of axial jaw 25 will be positioned in this longitudinal channel and will thus allow axial jaw 35 to move in and out of engagement with tubular member 13 as urged by cam surface 39. Positioned on axial jaw 35 is a load compensating device 37 which will be explained in greater detail below. Like pivoting jaws 20 and 21, axial jaw 35 will be provided with a die insert 25, shown in FIG. 1, with which to engage the tubular member 13.

Figure 2:
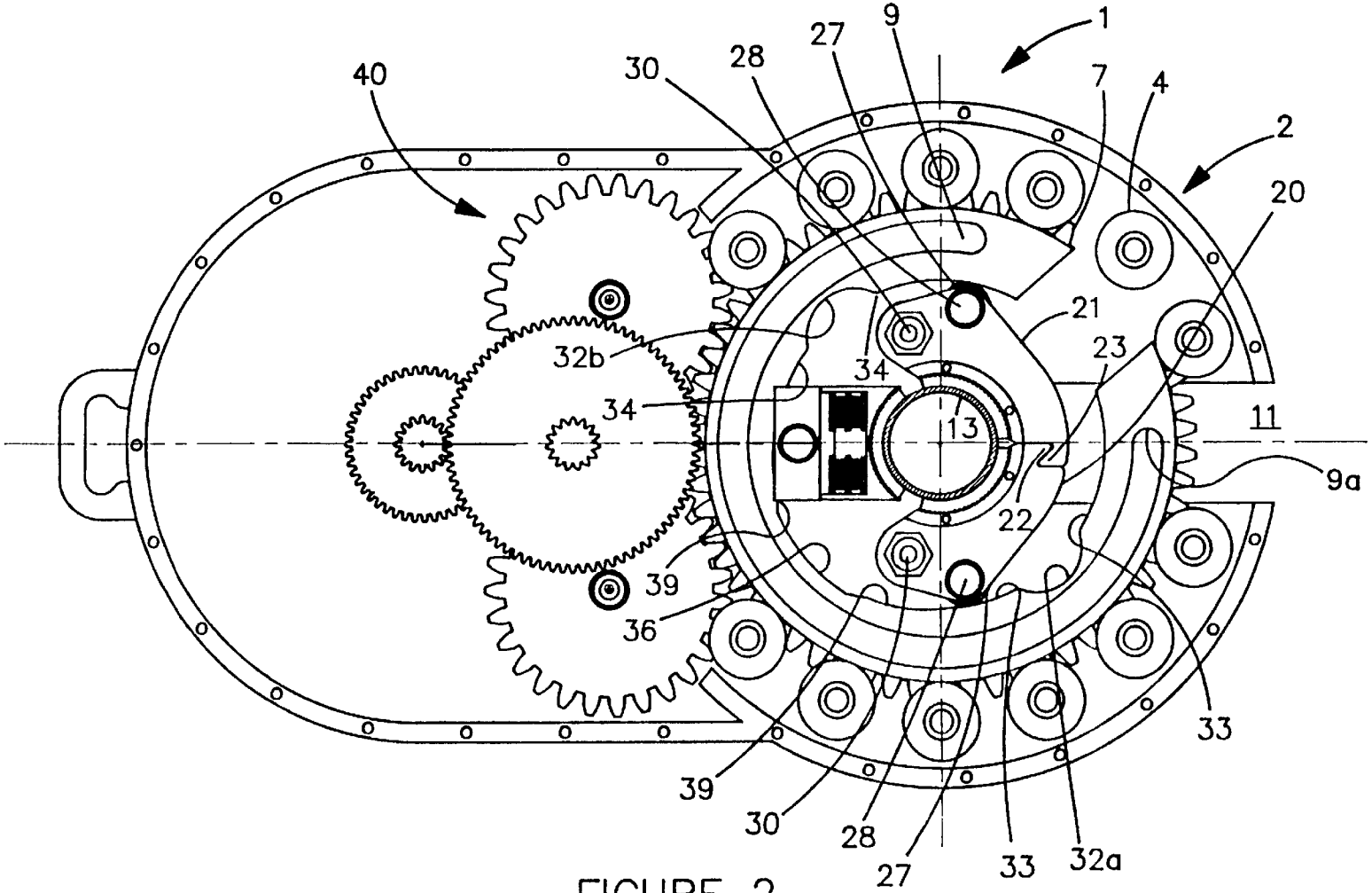
FIG. 2 is a top view of the present invention with the top cage plate removed showing the jaw members in a closed position.

The mechanism for opening and closing the jaws 20, 21, and 35 is provided by relative movement of ring gear 6 and the cam followers 27 on each of the jaws. As best seen in FIG. 2, ring gear 6 has a neutral cam surface 32*a*, 32*b*, and 36, for each jaw 20, 21, and 35, and cam surfaces 33, 34, and 39, formed on each side of the neutral surfaces respectively. The indentions 32*a* and 32*b* seen in ring gear 6 are the neutral surfaces for pivoting jaws 20 and 21, and the longer, less pronounced indention 36 is the neutral surface for axial jaw 35. Cam surface 33 will be formed on either side of neutral surface 32*a*, cam surface 34 on either side of neutral surface 32*b*, and cam surface 39 and either side of neutral surface 36. When the cam followers 27 engage neutral surfaces 32*a* and 32*b*, the pivoting jaws 20 and 21 can spread to the open position (as best seen in FIG. 2). Similarly, when the cam follower 27 of axial jaw 35 engages neutral surface 36, axial jaw 35 may be moved away from tubular member 13. Springs or other conventional biasing mechanisms will be used to bias the jaws in the open position whenever the cam followers are on a neutral surface. However, when it is desired to close the jaws, ring gear 6 can be rotated in either direction, forcing cam followers 27 onto the cam surfaces 33 and 34 for pivoting jaws 20 and 21 and cam surface 39 for axial jaw 35. As the cam followers 27 positioned on pivoting jaws 20 and 21 transition from neutral surfaces to cam surfaces, the cam followers 27 move toward the center point of power tongs 1, causing jaws 20 and 21 to pivot toward a closed position.

In order for jaws 20, 21, and 35 to properly grip tubular member 13, it is necessary for the jaws to close in a certain sequence. In the embodiment shown in FIG. 2, jaw hook 22 of pivoting jaw 20 must close on the tubular member 13 slightly sooner than jaw hook 23 of pivoting jaw 21 in order for the jaw hooks to be properly engaged. Additionally, jaw hooks 22 and 23 should be locked prior to axial jaw 35 closing on tubular member 13 and forcing tubular member 13 against pivoting jaws 20 and 21. This sequence of jaw closings is effected by the positioning of the cam surfaces on ring gear 6. Thus neutral surface 32*a* transitions into own surface 33 slightly sooner than neutral surface 32*b* transitions into cam surface 34, thereby causing pivoting jaw 20 to close slightly ahead of pivoting jaw 21. To insure the axial jaw 35 does not engage tubular member 13 prior to the pivoting jaws 20 and 21 locking, neutral surface 36 is comparatively longer than neutral surfaces 32*a* and 32*b*, which allows ring gear 6 to rotate some distance before axial jaw 35 transitions to cam surface 39. At the point cam follower 27 of axial jaw 35 engages cam surface 39 and closes on tubular member 13, pivoting jaws 20 and 21 will be locked.

As mentioned above, axial jaw 35 will include a compensating device that will limit the load axial jaw 35 transmits to tubular member 13. Generally, the axial load on tubular member 13 increases proportionately with the torque that is being applied by power tongs 1. There may be instances where the high torque loads needed to break apart a pipe joint may generate an axial load sufficient to crush or damage the tubular member 13. Therefore, a compensating device may be needed to insure that excessively high torque loads do not transmit to the tubular member excessive axial loads. Compensating device 37 may comprise a spring or any other resilient type device known in the art, such as a urethane composite material or a spring energizer. One example of a compensating device 37 can be seen in U.S. Pat. No. 4,709,599 to David Buck, incorporated herein by reference. After axial jaw 35 has engaged the tubular member 13 and the torque load begins to increase, the axial force on the tubular member 13 also begins to increase. Compensating device 37 is designed to allow a sufficient axial load to be transmitted to the tubular member 13 so that the serrations or gripping surface of the die insert grip or are embed into the outer skin of the tubular member 13. However, as the torque load rises, compensating device 37 will compress if the axial load being generated reaches a level that might damage tubular member 13; compensating device 37 thereby restricts the range of axis loads transmitted to tubular member 13. In this manner, the torque loads necessary to break apart the tubular member 13 joint may be reached without damaging axial loads being imparted to the tubular member 13.

Figure 3:
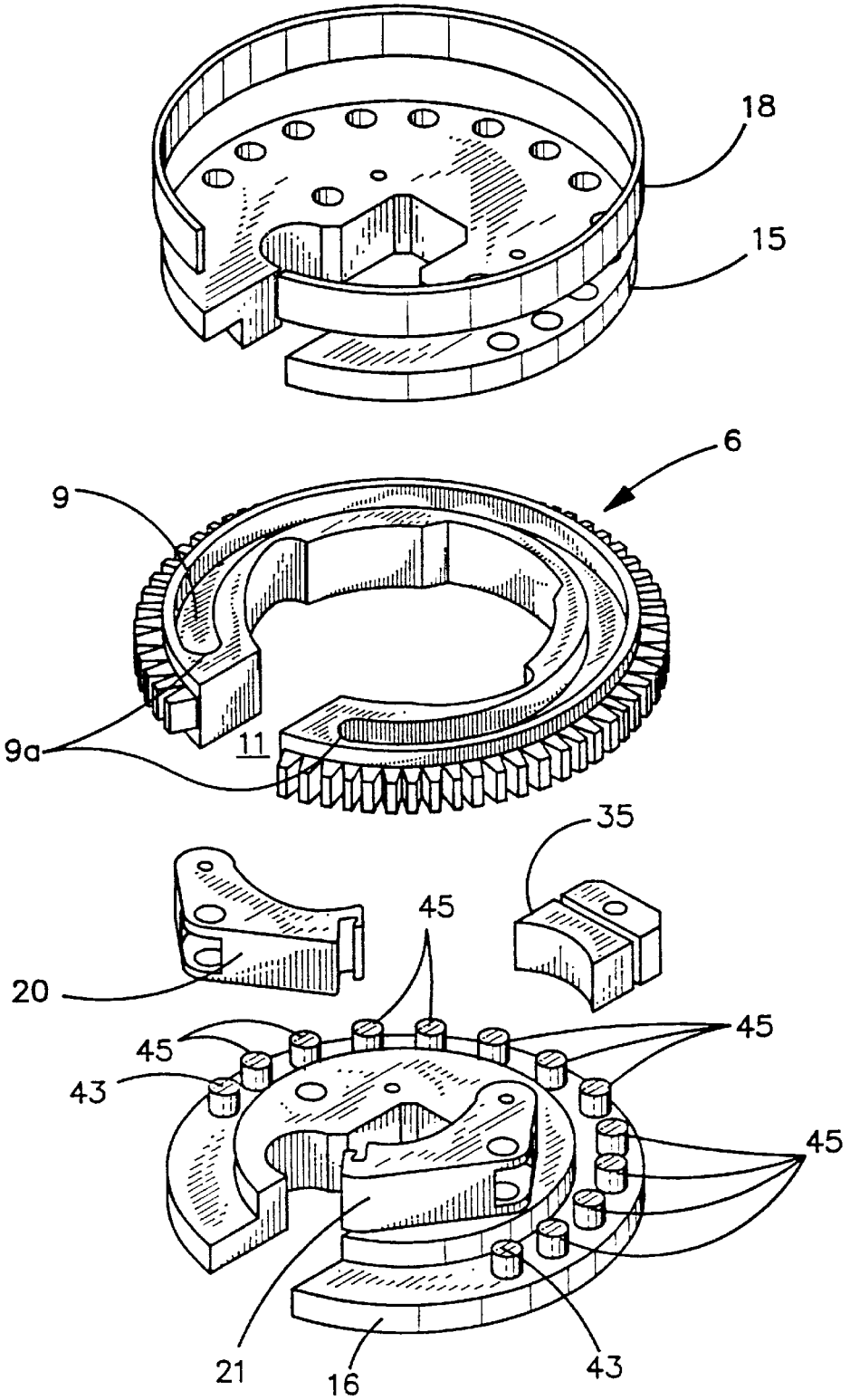
FIG. 3 is an exploded perspective view of the cage plates, jaws and ring gear of the present invention.

When power tongs 1 are put into operation, the jaws will intially be in the open position, as shown in FIG. 1. To engage power tongs 1 with tubular member 13, tubular member 13 is moved through throat 11 of power tongs 1 until contact with axial jaw 35. To grip the tubular member 13, power is supplied to drive train 40 which engages teeth 7 and begins to rotate ring gear 6. Initially, upper and lower cage plates 15 and 16 do not rotate with ring gear 6 because the cage plates are held in place by a brake band of conventional type. While not shown attached to the power tong body, FIG. 3 conceptually illustrates brake band's 28 relationship to top cage plate 15. As is shown in FIG. 3, the brake band will be positioned on the body of the power tong encircling upper cage plate 15 and is designed to assert contact frictional forces against upper cage plate 15. Brake band 18 will frictionally resist any torque imparted to the cage plates 15 and 16 and remains stationary with respect to ring gear 6. Brake band 18 generates sufficient frictional forces to prevent cage plates 15 and 16 from rotating with ring gear 6 while cam followers 27 transition out of neutral surfaces 32*a* and 32*b*. Pivoting jaws 20 and 21, being pivotally pined by pins 30 to cage plates 15 and 16, additionally remain stationary with respect to ring gear 6 while cam followers 27 transition out of neutral surfaces 32*a* and 32*b*. The initial rotation of ring gear 6 (seen rotating counter-clockwise in FIG. 2), causes the cam surfaces 34 and 33 to engage the cam followers 27 of pivoting jaws 21 and 20 respectively. However, because neutral surface 26 on which axial jaw 35 travels is longer than the neutral surfaces related to the pivoting jaws, axial jaw 35 closes after pivoting jaws 20 and 21 close. After pivoting jaws 20 and 21 have locked, ring gear 6 continues its rotation, and the cam follower 27 of axial jaw 35 passes neutral surface 36 and engages axial cam surface 39. At this point, all jaws have now engaged tubular member 13. Once engaged with tubular member 13, the jaws firmly grip tubular member 13 with the gripping surface of die inserts 25. Since pivoting jaws 20 and 21 are locked, the increasing gripping force on tubular member 13 will be generated by axial jaw 35, in effect, pushing tubular member against locked pivoting jaws 20 and 21. Therefore the angle of cam surface 39 continues to increase in order to move axial jaw 35 further against tubular member 113. However, the angles of cam surfaces 33 and 34 do not need to further increase once the pivot jaws 20 and 21 have fully closed in the locked position.

As ring gear 6 continues to rotate, axial jaw 35 will ride further up cam surface 39,—resulting in all jaws exerting an increased axial load on tubular member 13. This relative rotation continues to increase both the torque and the axial load on tubular member 13. Further rotation of ring gear 6 results in one or two possibilities. If the torque exerted by the jaws is sufficient, the threaded joint will loosen, at which point the jaws 20, 21 and 35 move as a unit with the ring gear 6, turning tubular member 13. Alternatively, if the torque is not sufficient to loosen joint of tubular member 1, ring gear 6 will continue to rotate relative to cage plates 15 and 16 until either compensating device 35 actuates preventing further build up of axial load, or until stop pins 43 on cage plates 15 and 16 contact with ends 9*a* of cage plate channel 9 on ring gear 6. If channel ends 9*a* and stop pins 43 meet, ring gear 6 and cage plates 15 and 16 will rotate together and produce no further axial load on tubular member 13. This arrangement prevents the axial load from increasing to a level that may overcome the loading capacity of compensating device 35 and possibly damage tubular member 13.

It will be understood that the operation shown by FIG. 2 is rotating the tubular member 13 in the counter clockwise direction to beak apart the threaded joint on the tubular member 13. All cam surfaces described herein are symmetrical and the exact same operation takes place in the clockwise direction when making up tubular joints.

Viewing FIG. 2, the significant advantages of the present invention over the prior art will become apparent. In the prior art, the reactionary forces generated in response to the axial load on the tubular member 13 could result in the spreading apart of open throated ring gears. Because the present invention interlocks the pivoting jaws 20 and 21, the spreading forces are transmitted to the pivot pins 30 and cage plates 15 and 16 rather than the cam followers 27 and ring gear 6. Therefore, the present invention helps to eliminate spreading forces on the ring gear 6.

Figure 4:
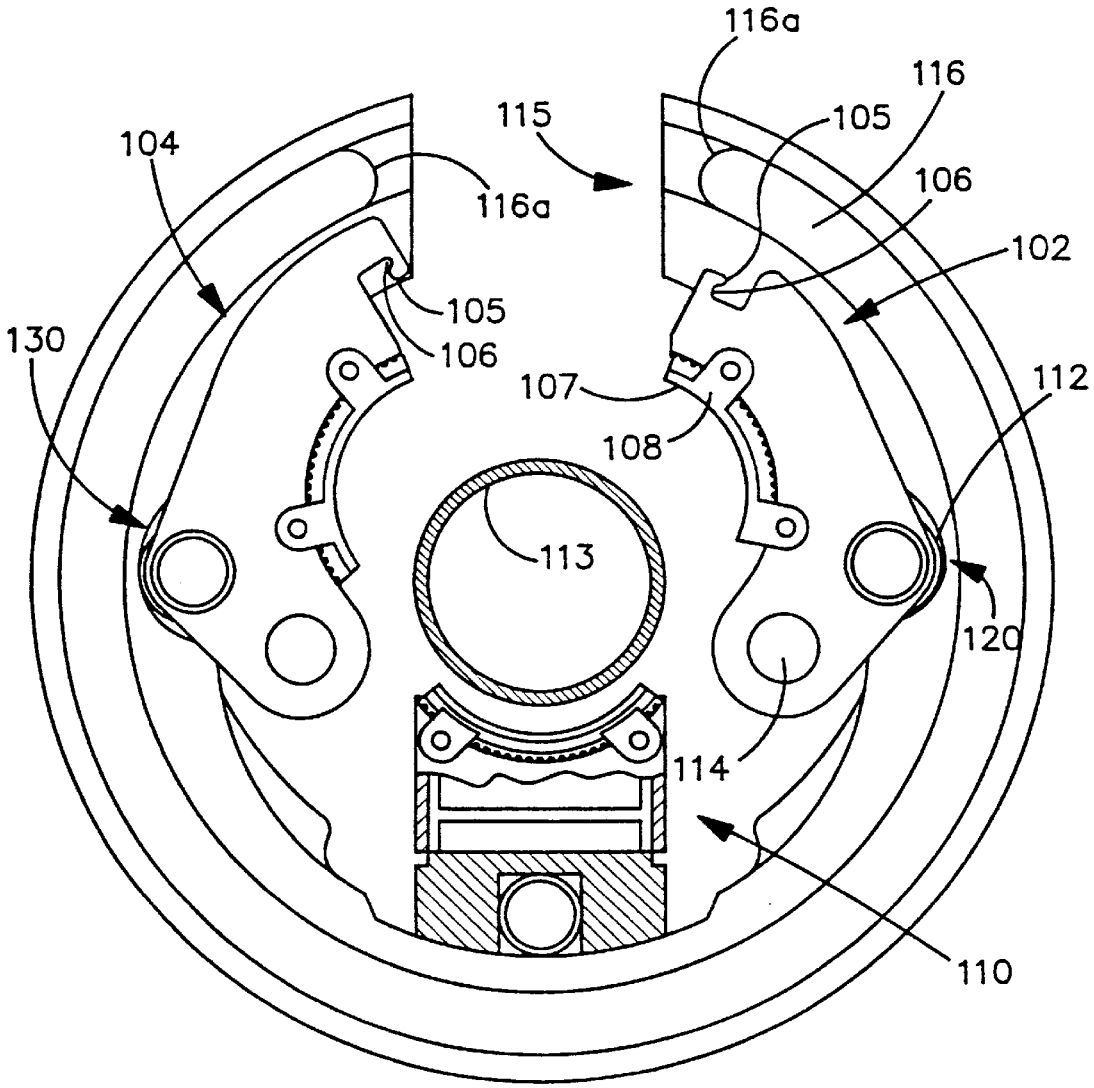
FIG. 4 is a top view of an alternate embodiment of the present invention will the jaws ally open.
Figure 5:
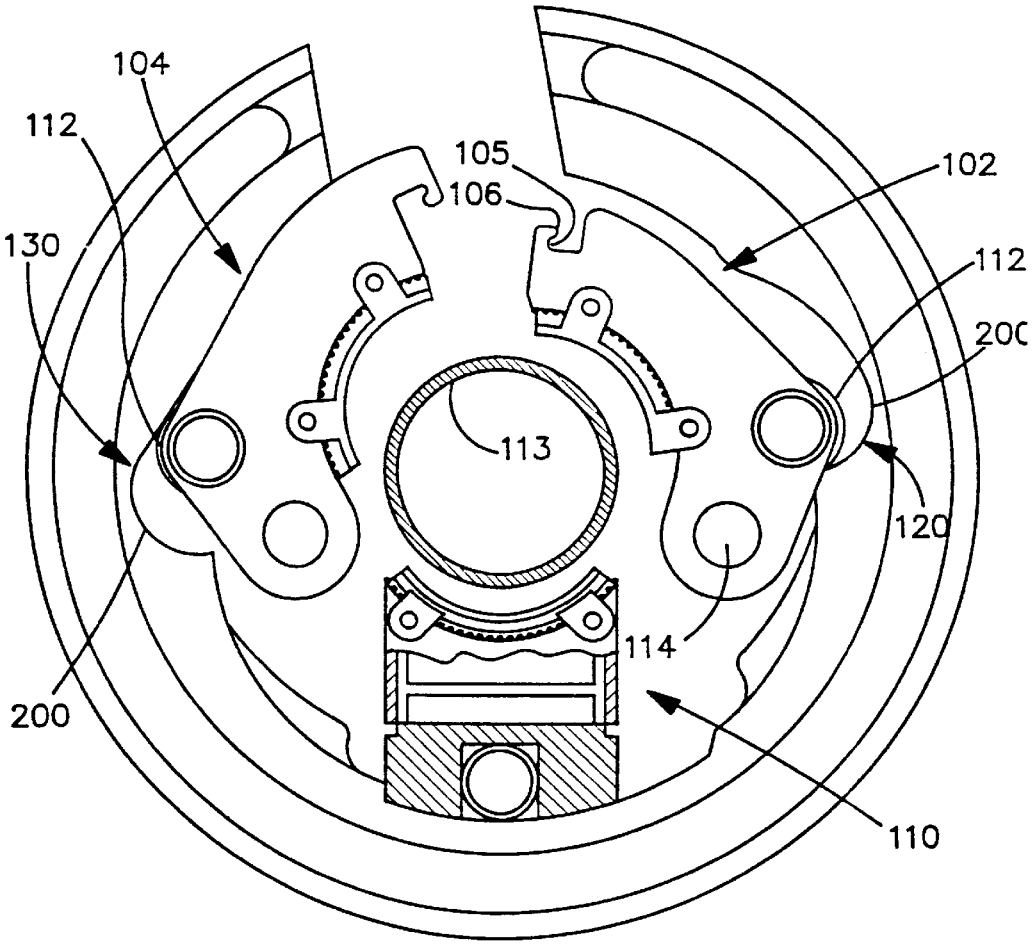
FIG. 5 illustrates the embodiment of FIG. 4 with the jaws beginning to close.

An alternate embodiment of the present invention includes a positive locking jaw assembly and is shown in FIGS. 4–7. Viewing FIG. 4, ring gear 115 is similar to previous embodiments in that it will have channel 116 and channel ends 116*a*. While not shown in FIGS. 4–7 for simplicity, it will be understood that ring gear 115 also has teeth around its outer periphery as does the previous embodiment. The jaw members 102 and 104 are also similar to the previous embodiments in that they have die inserts 107 and retaining clips 108 fixing inserts 107 in the jaw members. Jaw members 102 and 104 are connected to the upper and lower cage plates (not shown) by pivot pins 114. Jaw members 102 and 104 will also have cam follower 112 which will engage cam surfaces in order to move the jaw members into the closed position around tubular member 113. A spring or other conventional biasing device will bias jaw members 102 and 104 in the outward or open position as shown in FIG. 4. However, jaw members 102 and 104 differ from the previous embodiments in that each jaw member 102 and 104 includes a locking tooth 105 and a locking groove 106. Also difference are the cam surfaces 120 and 130; as shown the cam surfaces are not symmetrical about the neutral position 200. Viewing FIGS. 4–7 sequentially, those skilled in the art will appreciate how jaw members 102 and 104 will close such that locking tooth 105 engages the locking groove 106. An axial jaw 110 will also comprise an element of this embodiment and will function in a manner similar to the axial jaws describe in the previous embodiments.

Figure 6:
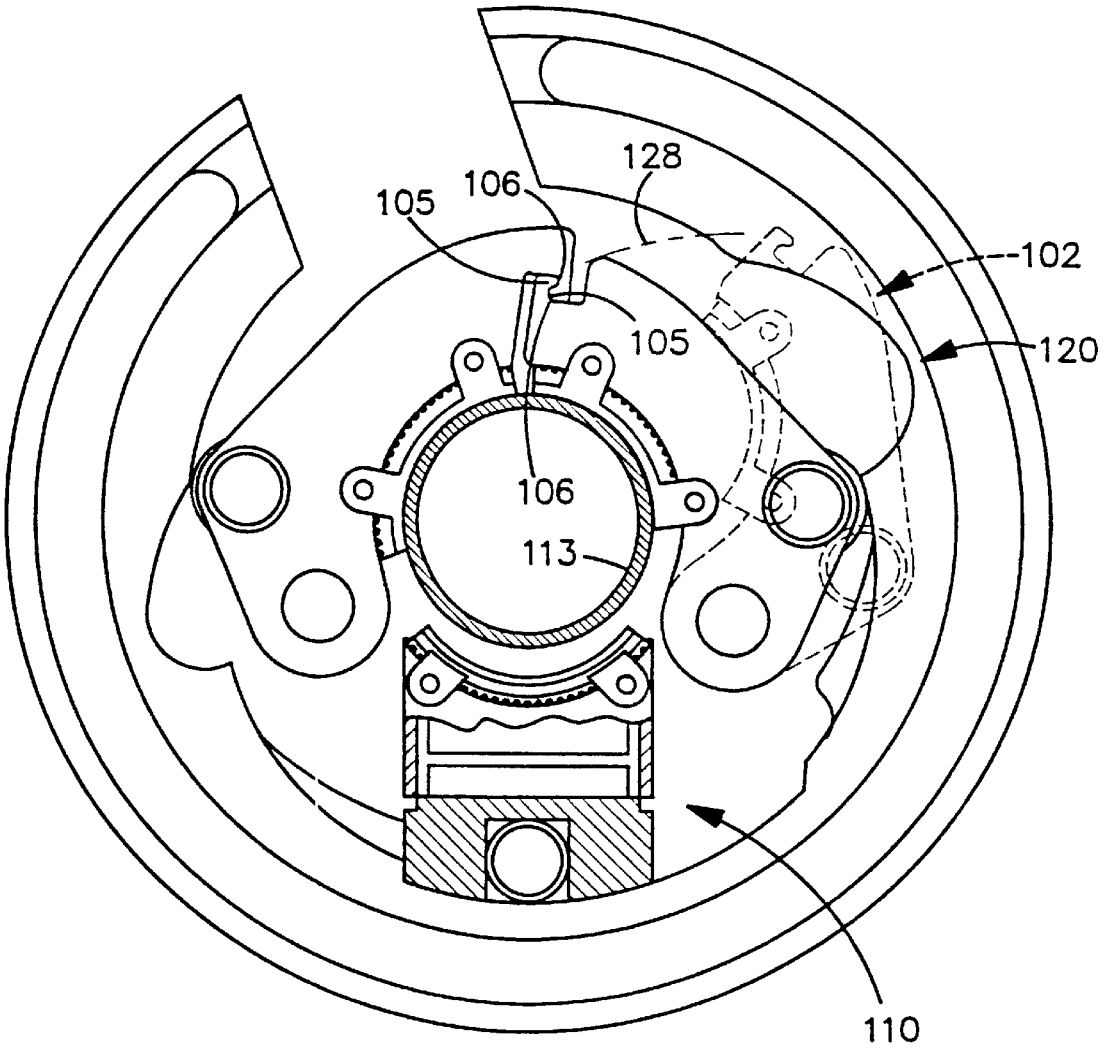
FIG. 6 is a view providing a phantom jaw in order to illustrate the path of the pivoting jaw.

FIG. 6 illustrates a phantom jaw member 102 in the open position and the same jaw member in the closed position (drawn in solid lines). The path taken by jaw member 102 is shown by the dashed path line 128. As explained in greater detail below, the shape of the opposing cam surfaces 120 and 130 formed on ring gear 115 will direct jaw member 102 along the path 128. It will be understood that the opposing cam surfaces are not symmetrical in order that jaw member 102 may close ahead of jaw member 104 as suggested by FIG. 5. Jaw member 102 moves along path 128 of FIG. 6 toward tubular member 113 and, once beneath jaw member 104, moves upward to interlock with jaw member 104. This allows locking tooth 105 of jaw member 102 to pass around locking tooth 105 of jaw member 104 such that the locking teeth 105 of both jaws may engage their respective locking grooves 106.

Figure 7:
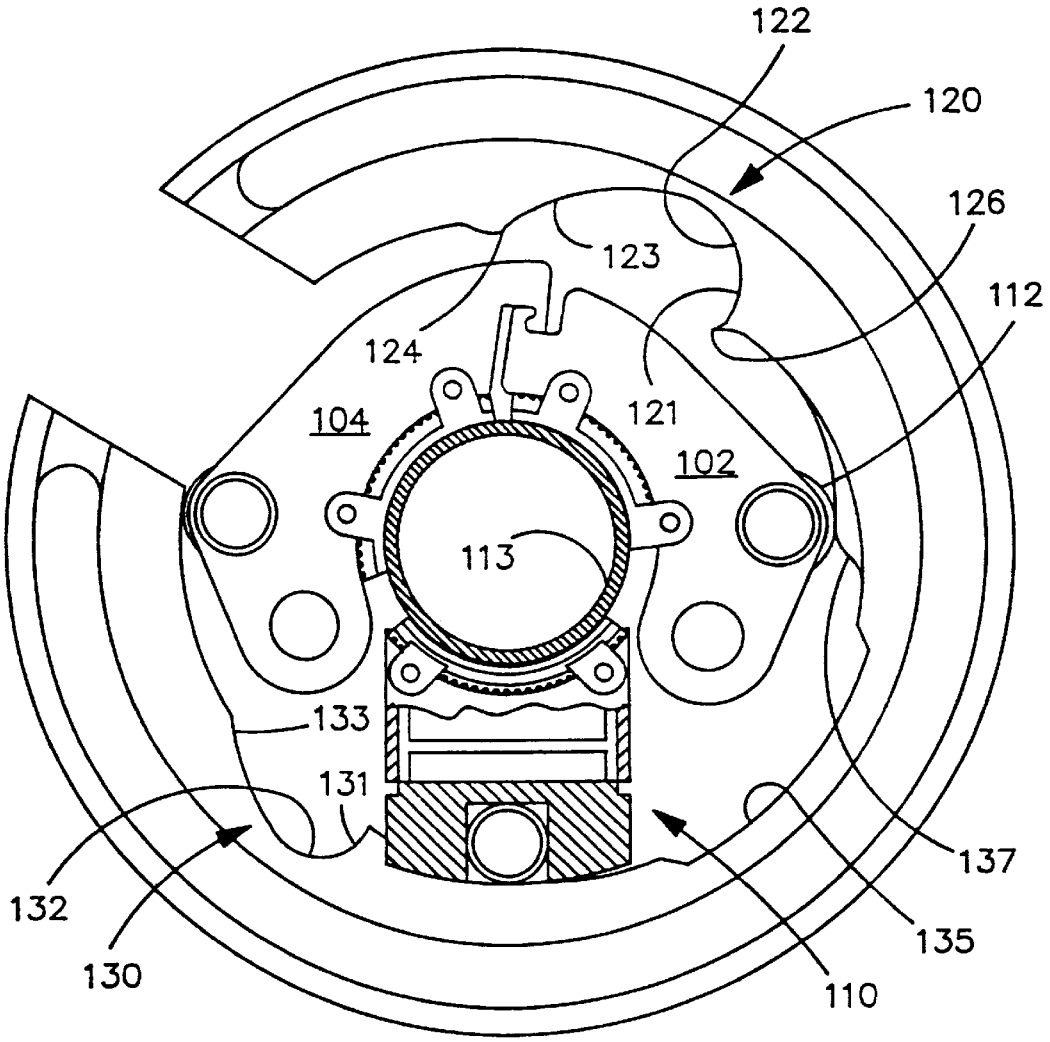
FIG. 7 is a view illustrating both the pivoting jaws and axial jaw in a fully closed position.

The cam surfaces 120 and 130 utilized to move the jaws along the proper path are best seen in FIG. 7. That figure illustrates the cam surfaces displaced from cam follower 112. Cam surface 120 corresponds to jaw member 102 and cam surface 130 to jaw member 104. The cam surfaces have a neutral surface 122 and 132 respectively against which cam follower 112 rest when the jaws are in the fully open position seen in FIG. 4. In FIG. 7, it can be seen that both cam surfaces 120 and 130 have lower angle front sections 123 and 133 and steeper angle rear sections 121 and 131. Those skilled in the art will understand that rear sections 121 and 131 may have much steeper cam angles because when the rear sections of the cam surfaces engage a cam follower 112, the jaw member pivots inwardly on pivot pin 114 and the cam follower 112 moves inwardly toward tubular member 113 and roller 112 may easily climb along the cam surface's rear section. However, when a cam follower 112 is engaging the front sections 123 or 133, the geometry of the jaws does not provide the same tendency for the pivoting jaws to rotate inwardly. Therefore, front sections 123 and 133 must have lower angles and longer surfaces in order to allow the jaw members to be more gradually directed in a inwardly moving path.

Cam surface 120 will also differ in shape from cam surface 130 because it is necessary for jaw member 102 to move under jaw member 104 in the path 128 described above. Therefore, cam surface 120 further comprises crown sections 124 and 126. The cam follower 112 mounting crown section 124 or 126 will cause locking tooth 105 on jaw member 102 to momentarily reach the lowest point on its path to the closed position. After passing crown sections 124 or 126, the slight descent of cam follower 112 will cause locking tooth 105 to raise slightly. This allows the locking tooth 105 on jaw member 102 to pass beneath the locking tooth 105 on jaw member 104, and then rise the small degree needed to correctly engage its respective locking groove 106.

It will be understood that locking tooth and locking groove combination described above provides a positively locking jaw assembly. While the jaw hooks illustrated in FIGS. 1–3 are a considerable improvement over the prior art, these locking hooks have certain potential disadvantages which are eliminated in the positive locking jaw assembly. For example, without the locking tooth and groove, the hooks shown in FIGS. 1–3 may not completely close when the tubular is gripped. If the hooks do not completely close, undesirable spreading forces may be transmitted to the ring gear. Additionally, there is the possibility that the smooth hook surfaces seen in FIGS. 1–3 could slip and the hooks become completely disengaged during operation. However, it will be apparent to those skilled in the at that the locking tooth and locking groove assembly eliminates these problems by creating a positive locking system where the jaws must close completely and slippage is not possible. Further, the embodiment of FIGS. 1–3 rely strictly on spring tension to separate the hooks when the tubular member is to be release. If the spring losses strength, there may arise instances where there is not sufficient force to overcome friction between the mating hook surfaces. On the other hand, the crown sections of the cam surfaces seen if FIGS. 4–7 cause the jaw member 102 to "kick" down and away from jaw member 104 forcing the jaw members apart on unlocking. These differences offer significant advantages over the jaw members shown in FIGS. 1–3.

Finally, while many parts of the present invention have been described in terms of specific embodiments, it is anticipated that still further alterations and modifications thereof will no doubt become apparent to those skilled in the art. It is therefore intended that the following claims be interpreted as covering all such alterations and modifications as fall within the true spirit and scope of the invention.

I claim:

1. A positive locking jaw assembly for an oil field tong comprising:

a. a first jaw member having, a cam follower, a first locking groove, and a first locking tooth;

b. a second jaw member having, a cam follower, a second locking groove, and a second locking tooth; and p1 c. a ring gear having a first cam surface engaging said cam follower of said first jaw member and a second cam surface opposing said first cam surface and engaging said cam follower of said second jaw member, said first and second cam surfaces being nonsymmetrical such that said first locking tooth moves below said second locking tooth as said jaw assembly moves to a closed position.

2. A positive locking jaw assembly according to claim 1, wherein said first and second jaw members are pivoting jaws.

3. A positive locking jaw assembly according to claim 2, wherein said pivoting jaws include a pivot point.

4. A positive locking jaw assembly according to claim 1, wherein said ring gear has a center opening and a nonpivoting axial jaw member positioned within said ring gear and moving in an axial direction toward said center opening.

5. A positive locking jaw assembly according to claim 1, wherein said cam surfaces have a front face and a rear face, said rear face comprising a steeper cam angle than said front face.

6. A positive locking jaw assembly according to claim 1, wherein one of said cam surfaces further has a crown section.

7. A locking jaw assembly for an oil field tong comprising:

a. a body having a rotating assembly with a center opening adapted to receive a tubular member, said rotating assembly further including a cage plate and a ring gear with cam surfaces formed on said ring gear; and b. first and second pivoting jaws connected to said cage plate with a pivot pin, said first and second pivoting jaws having cam followers and locking surfaces positioned thereon, whereby movement of said cam followers upon said cam surfaces interlocks said locking surfaces.

8. A locking jaw assembly according to claim 7, wherein said locking surfaces further comprise a locking tooth and a locking groove.

9. A locking jaw assembly according to claim 7, wherein said cam surfaces have a front face and a rear face, said rear face comprising a steeper cam angle than said front face.

10. A locking jaw assembly according to claim 7, wherein one of said cam surface further includes a crown section.

11. A locking jaw assembly according to claim 7, wherein said cam followers are positioned on said jaw members between said locking tooth and said pivot pin.

12. A locking jaw assembly according to claim 11, including a nonpivoting axial jaw moving in an axial direction toward said center opening.

13. A locking jaw assembly for an oil field tong comprising:

a. a body having a cage plate and a ring gear, said ring gear having two opposing nonsymmetrical cam surfaces positioned thereon, said body, cage plate, and ring gear having a center opening formed therein;

b. first and second pivoting jaws positioned within said ring gear, said first and second pivoting jaws having cam followers, pivot points and locking surfaces positioned thereon, whereby movement of said cam followers upon said cam surfaces interlocks said locking surfaces; and c. a nonpivoting axial jaw moving in an axial direction toward said center opening.

* * * * *